United States Patent [19]

Weiffen

[11] 4,278,536

[45] Jul. 14, 1981

[54] METHOD OF STARTING AN ELECTRO-PNEUMATICALLY ACTUATED WET-SETTLING MACHINE

[75] Inventor: Karl-Heinz Weiffen, Bochum, Fed. Rep. of Germany

[73] Assignee: Klockner-Humboldt-Deutz AG, Fed. Rep. of Germany

[21] Appl. No.: 19,465

[22] Filed: Mar. 12, 1979

[30] Foreign Application Priority Data

May 26, 1978 [DE] Fed. Rep. of Germany ..... 2823081

[51] Int. Cl.[3] ..... B03B 5/24

[52] U.S. Cl. ..... 209/422; 209/455; 209/500; 364/502

[58] Field of Search ..... 209/1, 422, 455, 457, 209/488, 489, 497, 499, 500–502; 364/502, 420

[56] References Cited

PUBLICATIONS

Bird, "How to Start and Regulate a Jig".

*Primary Examiner*—Ralph J. Hill

*Attorney, Agent, or Firm*—Hill, Van Santen, Steadman, Chiara & Simpson

[57] ABSTRACT

A starting method for an electro-pneumatically actuated wet-settling machine, for the separation of mineral mixtures, particularly coal, into their constituent components, in which the separation of the mineral mixture takes place through the pulsation of a separating liquid which is energized and controlled by means of compressed air in pulsation chambers which have electrically controlled air inlet and outlet valves, and in which the initiation of the wet-settling process takes place after a standstill, at least partially automatically, particularly through an electrically or electronically operating automatic starter, which starts at least some settling machine apparatus and/or their components in a predetermined dependency upon one another.

8 Claims, 1 Drawing Figure

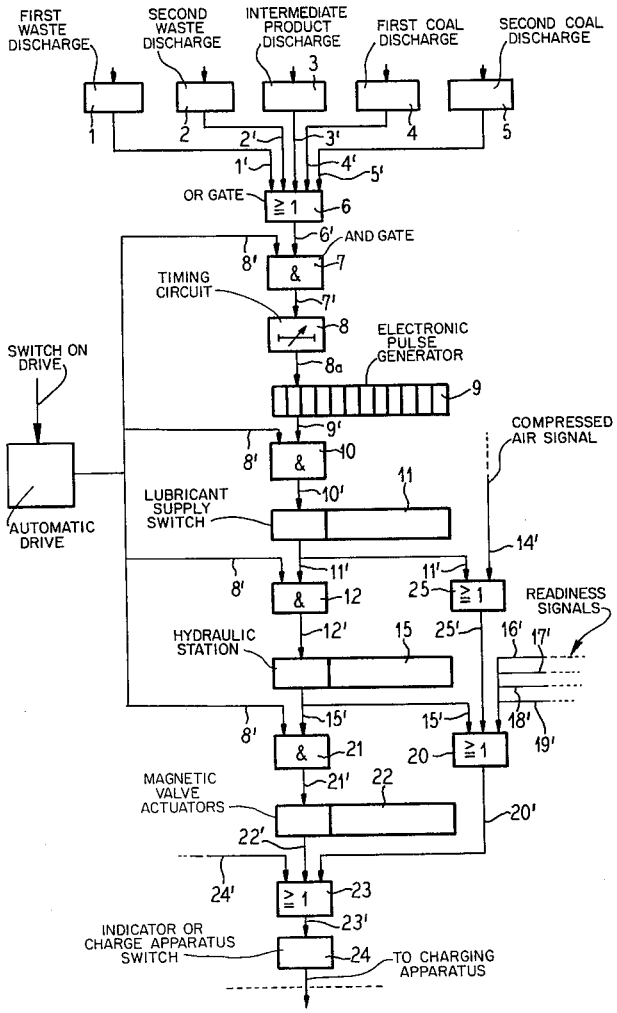

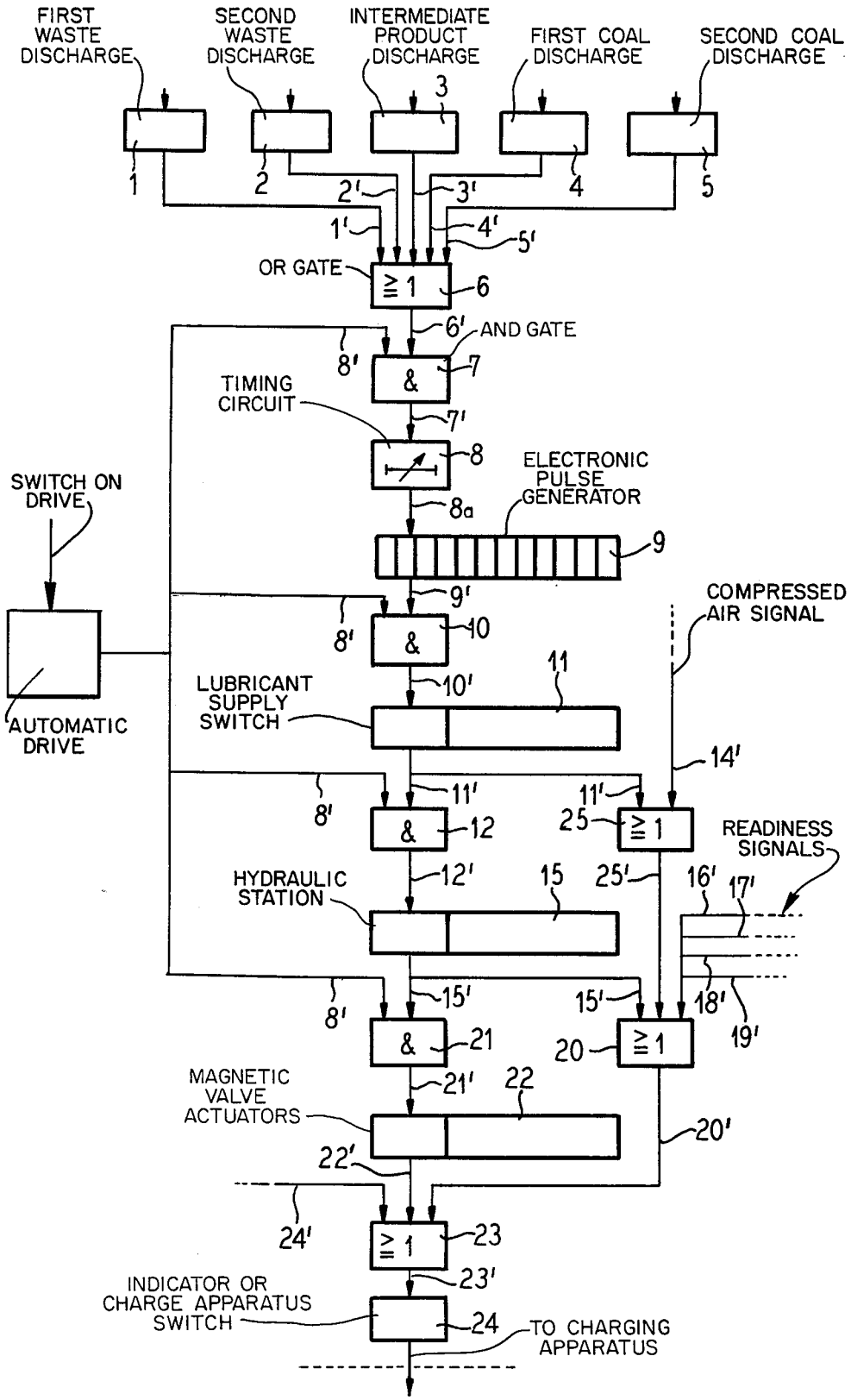
FIRST WASTE DISCHARGE
SECOND WASTE DISCHARGE
INTERMEDIATE PRODUCT DISCHARGE
FIRST COAL DISCHARGE
SECOND COAL DISCHARGE
OR GATE
AND GATE
TIMING CIRCUIT
ELECTRONIC PULSE GENERATOR
SWITCH ON DRIVE
AUTOMATIC DRIVE
COMPRESSED AIR SIGNAL
LUBRICANT SUPPLY SWITCH
HYDRAULIC STATION
READINESS SIGNALS
MAGNETIC VALVE ACTUATORS
INDICATOR OR CHARGE APPARATUS SWITCH
TO CHARGING APPARATUS

METHOD OF STARTING AN ELECTRO-PNEUMATICALLY ACTUATED WET-SETTLING MACHINE

BACKGROUND OF THE INVENTION

1. Field of the Invention

The present invention relates to a starting method for an electro-pneumatically actuated wet-settling machine for the separation of mineral mixtures, particularly coal, into its components, whereby the separation of the mineral mixture takes place by means of the pulsation movement of a separating liquid, which is energized and controlled by means of compressed air in pulsing chambers, which have electrically controlled air inlet and outlet valves.

2. Description of the Prior Art

Wet-settling machines, particularly coal-settling machines, are essential constituents of preparation installations for the preparation of minerals, for example, coals, which cooperate in the preparation installation with other aggregates connected in series in an upstream manner or in a downstream manner. The starting of the settling machines must, therefore, take place in consideration of the operational status of all elements of the preparation installation after interruptions in the operation, periods of standstill, etc., so that reliably and rapidly, the driving or starting of the aggregates connected in series is not impaired.

The starting of the settling machines occurs in a known manner in that the maintenance personnel starts, at the central control room of the preparation installation or at decentrally at the switching desk of the settling machine, first the pulsation movement of the settling machine, and then, when the material reaches from the apparatus connected in series to the settling machine, the conveyor apparatus of the settling machine is started for charging and extracting from the settling machine the materials, for example, the coal, and then as approximately simultaneously, the discharge apparatus of the settling machine is started. This known type of starting places, in this connection, high demands on the maintenance personnel, as the transporting apparatus, the discharge apparatus, etc., particularly in the case of very large settling machines, again have components to be individually taken into operation. Faulty switch connections upon starting are, therefore, not out of the question. Therefore, sometimes it comes to the fact that the taking into operation of the individual components is delayed by means of disturbances, so that the appertaining apparatus does not permit of being started. Then, the starting operation of the settling machine under certain circumstances must be broken off and, after removal of the disturbance, started anew. In both cases, it comes to disturbances of the entire preparation installation.

SUMMARY OF THE INVENTION

It is the object of the present invention, therefore, to provide a starting method for wet settling machines, particularly for large wet settling machines, for the preparation of coal, which overcomes the previously-mentioned disadvantages. Reliability in protecting the driving or starting from faulty switch connections, and especially an acceleration of the same is particularly desired.

Furthermore, it is to be attained, that a delay in the initiation of operation of the individual components of the apparatus of the settling machine leads to a prolongation of the starting period, the starting operation, however, no longer must be initiated again, so that also in these cases it does not come to a disturbance of the starting of the entire installation.

The above object is achieved, in that the starting of the settling machine after a standstill takes place, at least partially automatically, particularly by means of an electrically operating automatic drive or an electronically operating automatic drive, which at least starts some settling machine apparatus and/or their components in predetermined dependence on one another. By means of this construction, according to the present invention, advantageously the maintenance personnel is relieved of the fact of starting the settling machine apparatus and their components individually with a correct sequence and having to supervise their orderly functioning for the undertaking of further starting steps. Through automatization, it is possible to start the most important settling machine apparatus and their components in a predetermined advantageous order, and particularly with the greatest possible speed and accuracy.

In accordance with a particular development of the invention, it is provided that at least individual settling machine apparatus and/or components, for example, the transporting apparatus and the pulsation control connected through the automatic arrangement, are connected with one another by means of interlocking switch systems, particularly through AND members. An interlocking switch arrangement offers the possibility, in a particularly reliable and simple manner, particularly through known electromechanical or electronic AND members to automatize in pre-programmed sequence the starting of a settling machine. Therefore, advantageously, with the same reliability, a substantially more expensive control, approximately with a process computer which operates with individual switching-on of the individual apparatus and components, according to the type of manual control, may be eliminated.

In a further development of the invention, it is provided that the automatic starting of the switching-on signals for starting operations releases at least partially preadjustably time-delayed further settling machine apparatus. Through the preadjustable time-delayed release of further settling machine apparatus, the reliability of the starting steps is further increased. Upon starting of the individual components, short-period disturbances do not take effect on the starting operation in its entirety; the starting operation progresses constantly. Furthermore, the control of functioning is facilitated.

In a further embodiment of the invention, it is provided that the release signals and/or functioning signals of the starting method or procedure pass through a fixedly-programmed switching path having continuous further through-connections after input of the functioning signals. In this manner, the interlocking switch system is constructed particularly advantageously. The fixed-programmed switch path having continuously further through-connection may be received on easily exchangeable plug-in cards and may be altered without further ado. As plug-in cards, in a particularly simple manner, relay plug-in cards of known construction may be employed.

In a further embodiment of the invention, it is provided that the release signals and functioning signals pass through auxiliary contact paths extending parallel and adjacent a main through-connection and jumping over particular switching stations. Through the auxiliary contact paths, according to the invention, it is possible to insure, in addition, the run-off of the starting operation, and in this manner, AND conditions are imparted repeatedly to members of the main switching path. Therefore, there results upon cutting-out of the essential AND conditions, an immediate influencing of the starting operation in the controlled switching member actually later switched-on in the main switching path upon obtaining a through-connection. Timing members built into the main switching path may therefore be jumped over by essential AND conditions imparted already, with respect to time, previously to the main switching path.

In another development of the invention, it is provided that, at the beginning of starting, first the transporting apparatus for the removal of the individual components of the mineral mixture are brought into operation, advantageously, as a group. Through the first operation following starting of the removal paths, it is attained that the further course of the starting operation and the further progress of the removal of material is insured. This is important, particularly for large settling machines. A failure of the material removal would lead to a clogging and over filling of the machine by means of appreciable quantities of material; and a longer-lasting interruption of the operation would be the result. The starting operation, accordingly, began surprisingly advantageously in the case of the settling machine apparatus, which is found in operation at the end of the material path.

In a further development of the invention, it is provided that subsequent to the starting of the transporting apparatus for the removal of material, the valve control of the pulsing chambers of the settling machine is connected. The switching-on of the valve control of the settling machine insures that the sorting operation in the settling machine may began at any time, as through the valve control, the pulsation movement is started in the settling machine. The starting of the valve control lies advantageously behind the starting of the removal apparatus, as the preparation of operation of the control may be omitted when the removal apparatus do not operate.

In a further development of the invention, it is provided that subsequently to the switching-on of the valve control, the lubricating oil supply for the valves and the other components of the pneumatic control system, the discharge apparatus for the discharge of the individual minerals, as well as the operating compressed air system start; they are, in particularly, started consecutively. By means of these starting operations, advantageously the condition of preparation for operation of the machine is produced, whereby the starting consecutively of the maintenance personnel offers particularly favorable the opportunity, on the basis of control lamps and indicator devices, to supervise the functioning of the individual apparatus. Furthermore, it is possible to develop the starting operation corresponding to the specific machine-dependency of the individual components and apparatus with respect to one another. In this connection, the interlocking switch system, according to the present invention, offers the most favorable prerequisites for a reliable operation.

In a further development of the invention, it is provided that, after the starting of the removal apparatus and all partial components of the wet settling machine, the charging apparatus for the mineral mixture is started. By means of this embodiment or construction of the invention with respect to the starting procedure, it is insured that no material may arrive into the settling machine during the starting operation of the settling machine. Therefore, it is reliably permitted that the taking into operation of the individual apparatus and components is disturbed by means of the material. Subsequently to the starting of the charging apparatus, the settling machine is ready for operation and may receive material from the parts of the preparation installation connected in series. The taking into operation then takes place by means of corresponding signals from a central control of the preparation installation.

In a further development of the invention, it is provided that the starting of the charging apparatus for the mineral mixture actuated manually takes place after an optical and/or acoustic signal of readiness for operation of the automatic starter by means of the maintenance personnel. This step, which replaces the fully automatic switching-on of the charging apparatus, is of advantage, as therefore the maintenance personnel has once more the possibility of testing the readiness for operation of the settling machine and of ascertaining whether the switching-on of the settling machine is possible and necessary within the scope of the entire installation.

In a further embodiment of the invention, it is provided that the individual switching path stations of automatic operation are reversible or may be switched-over to manual operation. Hereby, it is advantageously possible to test whether the individual apparatus and/or components, particularly after repairs, operate functionally. In this connection, it is provided that the individual switching path portions, for purposes of testing, are constructed individually or in groups, so as to be switched over from automatic operation to manual operation.

In a further embodiment of the invention, it is provided that for the disconnection of the starting operation or of the operating condition of the settling machine, the through-connection signal of the main switching path is removed, preferably through disconnection of the removal group, whereby through the normal signal path, first a particularly preadjustable time member is controlled. In the same manner as the automatic connection takes place, also an automatic disconnection occurs. The disconnection is released by means of the elimination of an AND condition in the switching path. A complete disconnection takes place, in this connection, through the elimination of the first AND condition, of the function signal of the removal group. Hereby, the entire through-connection signal of the main switching path is extinguished or erased. Through the disconnection of the removal group, therefore, the automatic disconnection of the settling machine is effected. In the same manner, however, it would now work out also, short-term unintentional standstill of the removal apparatus, is account for, which on the account of the storage effect present of the individual settling machine parts, particularly of the funnel in the lower part of the settling machine, would not make a disconnection necessary. By means of the control of the timing member, now advantageously it is prevented that a short-term standstill of the removal group or parts thereof, which would not further disturb the operation of the settling machine, shuts off the settling machine. In this manner, it is advantageously possible through the switch paths present of the starting connection, also to carry out an automatic disconnection and, in spite of this, to take care of a continuous operation, if only slight short-term stoppages occur.

BRIEF DESCRIPTION OF THE DRAWING

Other objects, features and advantages of the invention, its organization, construction and operation will be best understood from the following detailed description, taken in conjunction with the accompanying drawing, on which their is single figure which details the starting procedure of a wet-settling machine in accordance with the principles of the present invention.

DESCRIPTION OF THE PREFERRED EMBODIMENTS

Referring to the drawing, a circuit diagram illustrates the starting condition of a wet settling machine having two waste discharges, an intermediate product discharge and two coal discharges. The settling machine, itself, is a machine similar to the underpulsed settling machine of the Batac Type of KHD Industrieanlagen AG Humboldt Wedag, as is described on pp. 43–49 in the publication "Mining Congress", Washington, D.C. The electronic pulse control for such a machine is described in the prospectus of the Wedag Westfalia Dinnendahl Groeppel AG, No. 5175 4-69 "Elektronisch gesteuerte Setzmaschenventile" (Electronically Controlled Settling Machine Valves). The individual switching elements are electronic and electromechanical structural parts known in the art, as they are known from the publications of technical firms which provides such apparatus. Therefore, approximately relay plug-in cards of the BTR, Badische Telefon-und Relaisbau, A. Heber, or equivalents thereof are utilized. It is also possible to operate with programmable-control inserts, for example of the type Fanalog PC 12 of the Firm Metzenhauer & Jung, Wuppertal, or with signal converters, for example of the BBC Metrawatt.

In the circuit diagram of the drawing, the blocks 1–5 designates removal apparatus for the different materials. The reference character 1 references the first waste discharge, the reference character 2 designates the second waste discharge, the reference character 3 designates the intermediate product discharge, the reference 4 indicates the first coal discharge and the reference character 5 indicates the second coal discharge. During operation, the individual removal apparatus 1–5 emits respective signals 1'–5'. The signals are fed to respective inputs of an addition gate 6 and thus produce a common signal 6' for the interlocking switching system. The signal 6' is imparted to an AND gate 7 from which, upon the presence of the AND condition, the switch-through signal 7' is emitted. The AND condition is fulfilled when, at the AND gate 7, the signal 6' and the signal 8' are present. The signal 8' occurs when the automatic drive is switched on and is a matter of a switch being operated for "automatic", as opposed to, manual operation.

The signal 7' of the AND member is now first imparted to a time member 8, from which it passes on as a signal **8*a*. The time member 8 prevents a short-term stoppage in one of the removal apparatus, as it may easily occur especially shortly after the starting, from leading to an unnecessary interruption of the driving operation, as the time member 8 maintains the signal 8' up to expiration of the pre-set time even upon elimination of the signal 7'. The time member 8** will be adjusted, as a rule, in the minutes range.

The switch-through signal **8*a* from the time member 8*a* now activates an electronic pulse control 9 of the valves developed in plug-in card form, and activates the control 9. The valve control 9, in plug-in form, advantageously permits an easy and reliable exchange of the electronic control parts. From the valve control 9 there occurs, after activation, the further through-connection signal 9', which acts on the AND gate 10, at which occurs, as a further AND condition again, the automatic connection signal 8'. If the AND condition is attained, the through-connection signal 10' is released, which activates the switching station 11 of the lubricant oil supply. After the operation of the lubricant oil connection station 11, the signal 11' is released to the AND gate 12, on which likewise again occurs the automatic connections signal 8'** as an AND prerequisite.

The signal 11' acts, at the same time, on the AND gate 12 and on the addition member 25, where is combined with the signal for the sufficient compressed air supply 14'. The signal 12' in the main switching path activates the hydraulic station 15 (pressure oil station 9 of the "Mining Congress" article) of the discharge apparatus for the settling machine. The signal 15' emanating from the station 15 is fed to an addition gate 20, where it is combined with the signal 25' and with the further secondary signals 16', 17', 18' and 19' indicating the readiness of the downstream elements of the entire preparation installation, to signal the result 20'.

In the main switching path, the signal 21' reaches from the AND gate 21 to the magnetic actuation devices for the air valves 22. From here, the signal 22' of the main switching path, as well as the signal of the parallel switching path 20', reaches the addition member 23, where still the after presence of the signals 20', 22' and 24' (an after-wash signal such as a downstream water clarifier, cf. the "Mining Congress" article) releases the operation-readiness signal 23', which operates the indicating device 24 for indicating the operational readiness of the settling machine. In the normal course of events, now the connection of the charging apparatus undertaken by the maintenance personnel. The indicating member, however, may also be replaced by a switching member for the connection of the charging apparatus for the mineral mixture, an automatic operation, then the entire starting operation is automated.

The starting method according to the present invention is utilized not only for electronically-controlled settling machines, but for all settling machines. Instead of electronic valve controls, the corresponding valve control in accordance with the present invention may be drawn into the starting operation. The advantageously simple connection through AND gates and time members leads, also, in the case of mechanical controls to the automatic, absolutely reliable and disturbance-free, operation of the settling machine, in accordance with the present invention.

Although I have described my invention by reference to a particular illustrative embodiment thereof, many changes and modifications of the invention may become apparent to those skilled in the art without departing from the spirit and scope of the invention. I therefore intend to include within the patent warranted hereon all such changes and modifications as may reasonably and properly be included within the scope of my contribution to the art.

I claim:

1. A method of starting an electro-pneumatically actuated wet settling machine which has electrically-controlled inlet and outlet valves, a compressed air system, a lubricating oil supply for the valves, discharge apparatus, removal apparatus, charging apparatus, a hydraulic station for the discharge apparatus, and an automatic drive control, for the separation of mineral mixtures into constituent components, in which separation takes place through the pulsation of a separating liquid in a separating chamber controlled by the introduction and exhaust of pressurized air into and from pulsation chambers which communicate with the compressed air supply by way of the inlet and outlet valves, comprising the steps of:

starting the removal apparatus which removes the individual components of the mineral mixture;

starting the lubricating oil supply for the inlet and outlet valves;

starting and operating the inlet and outlet valves in a predetermined sequence;

activating the compressed air system to cause pulsation of the separating liquid via the inlet and outlet valves;

starting the hydraulic station for operating the discharge apparatus for discharging the individual components; and starting the charging apparatus to feed the mineral mixture to be separated to the separation chamber.

2. The method of claim 1, wherein the steps are performed in the specific order set forth.

3. The method of claim 1, comprising the steps of:

generating and adding signals indicative of starting of the removal apparatus to provide a first signal indicative of completion of the removal apparatus starting step; and combining the first signal conjunctively with an automatic drive signal to provide a second signal; and delaying the second signal.

4. The method of claim 3, comprising the steps of:

applying the delayed second signal to a control circuit to initiate operation of the inlet and outlet valves; and generating a third signal indicative of operation of the inlet and outlet valves.

5. The method of claim 4, comprising the steps of:

conjunctively combining the third signal and the automatic drive control signal to provide a fourth signal; and applying the fourth signal to the lubrication oil supply to activate the same and cause generation of a fifth signal.

6. The method of claim 5, comprising the steps of:

conjunctively combining the automatic drive control signal and fifth signals to provide a sixth signal; and applying the sixth signal to a hydraulic station to start the discharge apparatus and cause generation of a seventh signal.

7. The method of claim 6, comprising the steps of:

conjunctively combining the automatic drive control signal and seventh signals to provide an eighth signal; and applying the eighth signal to a control circuit to start operation of the valves and cause generation of a ninth signal.

8. The method of claim 7, wherein the settling machine includes an indicator, and comprising the steps of:

generating a tenth signal in response to activation of the compressed air supply;

adding the fifth and tenth signals to provide an eleventh signal;

adding the seventh, eleventh and readiness signals from other operations to provide a twelfth signal;

adding the twelfth, the ninth and an after-washing signal to provide a thirteenth signal; and applying the thirteenth signal to the indicator.

* * * * *